United States Patent [19]

Allman et al.

[11] Patent Number: 4,658,135

[45] Date of Patent: Apr. 14, 1987

[54] METHOD AND APPARATUS FOR SENSITIVE ATOM COUNTING WITH HIGH ISOTOPIC SELECTIVITY

[75] Inventors: Steve L. Allman, Knox County; Norbert Thonnard, Anderson County; George S. Hurst, Roane County, all of Tenn.

[73] Assignee: Atom Sciences, Inc., Oak Ridge, Tenn.

[21] Appl. No.: 776,598

[22] Filed: Sep. 16, 1985

[51] Int. Cl.[4] ..... H01J 49/26

[52] U.S. Cl. ..... 250/283; 250/282; 250/288

[58] Field of Search ..... 250/283, 282, 281, 288

[56] References Cited

U.S. PATENT DOCUMENTS 4,426,576 1/1984 Hurst et al. ..... 250/283

4,442,354 4/1984 Hurst et al. ..... 250/281

*Primary Examiner*—Bruce C. Anderson

*Assistant Examiner*—Jack I. Berman

*Attorney, Agent, or Firm*—Pitts and Brittian

[57] ABSTRACT

Method and apparatus for determining small quantities of specific atoms with isotopic selectivity. According to the method described herein, atoms are rapidly released from an atom bank containing the same, and are then converted to ions utilizing resonance ionization as achieved with photon beams having specific wave lengths. These ions are extracted from the ionization region and are accelerated and implanted into a second atom bank. For further selectivity, the atoms are then rapidly released from the second bank, ionized with another photon beam of selected wave length to provide ionization of the desired species, with these ions then being extracted, subjected to acceleration, and implanted into the first atom bank. Typically the number of electrons emitted from the atom banks during implantation is used as a measure of the number of atoms of the selected species. In the preferred embodiments, a combination of mass selectivity by ionization together with a mass separator provides for the most rapid and most sensitive method for determining a small quantity of atoms in the presence of a large quantity of atoms.

27 Claims, 8 Drawing Figures

METHOD AND APPARATUS FOR SENSITIVE ATOM COUNTING WITH HIGH ISOTOPIC SELECTIVITY

TECHNICAL FIELD

This invention relates to an analytical method and apparatus for the selective counting of a very small quantity of a substance in the presence of an abundant substance of similar mass, and more particularly to a method and apparatus for counting noble gas atoms of one isotope in the presence of other abundant isotopes of that noble gas. It is applicable, also, to other atoms capable of forming an atom bank.

BACKGROUND ART

Noble gas atoms occur in nature with unique isotopic ratios depending upon the source of the atoms. A wide variety of applications for isotopically selective counting of these noble gas atoms has been identified, and many of such applications necessitate the counting of a small number of atoms of one isotope even when the neighboring isotope may be more abundant by twelve orders of magnitude. Some of the applications are: (1) ground water dating by detecting the small number (e.g., 500) atoms of Kr-81 removed from 1 liter of water; (2) polar ice dating by also detecting small quantities of Kr-81; (3) atmospheric studies through the detection of Kr-85 and isotopes of Xe; and (4) ocean water circulation where a few atoms of Ar-39 are present with as many as $10^{19}$ atoms of Ar-40 in a liter of ocean water.

A variety of measuring techniques have been developed to be utilized in the detection of, in particular, radioactive isotopes. One such technique utilizes radioactive decay. This is a slow process, and is not effective for very small quantities (even down to one atom). It is also impractical for radioactive isotopes having very long half-lives, as is the case for Ar-39 and Kr-81. Furthermore, conventional mass spectrometers are limited in sensitivity, requiring more than $10^8$ atoms in most cases, and suffer from isobaric interferences. Thus, more rapid and precise techniques have been needed, and some have been developed. Several of these improved techniques are based, at least partly, upon resonance ionization spectroscopy (RIS) as disclosed in U.S. Pat. No. 3,987,302, issued on Oct. 19, 1976, and assigned to the common assignee of this invention. This patent is incorporated herein as reference for any teaching that is not covered in sufficient detail herein.

Two other patents assigned to the common assignee, and incorporated therein by reference for their teachings, are U.S. Pat. No. 4,426,576, issued Jan. 17, 1984, and U.S. Pat. No. 4,442,354, issued Apr. 10, 1984. One of the inventors of all of these cited patents is one of the inventors of the present invention. Of these later two patents, the '576 patent is most pertinent to the present invention. It specifically is directed toward the detection of noble gas atoms. It provides for a method in which the vacuum is static during the collection of separated atoms, and is followed by active pumping to remove residual materials before a cycle can be repeated. A substantial length of time is required for counting of the desired (selected) atoms. Furthermore, use of a static vacuum system causes interferences due to background atoms. In addition, the method and apparatus of that patent can only accomodate one sample at a time so that a comparison cannot be made with another sample or "standard".

Accordingly, it is a principal object of the present invention to provide a method and an apparatus that permits the counting of a very few atoms of a selected specie wherein there is a very abundant quantity of potentially interferring species, the method providing for very rapid counting.

It is another object of the present invention to provide a method of counting very few atoms of one isotope of an element in the presence of an abundant quantity of atoms of other isotopes of that element, with that method providing rapid information.

It is still another object of the present invention to provide a method of and apparatus for counting very few atoms of one substance in one sample, such as an isotope of an element, in the presence of another substance or isotope of abundant quantity in that sample, and wherein such counting can be accomplished during the counting of similar atoms from a second sample.

These and other objects of the present invention will become apparent upon a consideration of the detailed description and by reference to the drawings.

SUMMARY OF THE INVENTION

In accordance with the invention, a method and apparatus are provided for rapidly separating and counting selected atoms from a mixture of atoms, the counting being of individual atoms with isotope selectivity, both radioactive and stable. More particularly, atoms of the selected noble gas contained within an "atom bank" are quickly driven from the bank, as with a laser pulse, and are thereafter subjected to a resonance ionization beam of specific wavelength whereby the atom (or isotope) of interest is selectively ionized. These ions are subjected to mass separation to provide further selectivity, and are then implanted into another target forming a second atom bank. The steps are repeated for the second atom bank, with further separated atoms being implanted in the first atom bank. If desired, the second atom bank can contain a reference sample that is being processed simultaneously whereby a comparison can be made.

DETAILED DESCRIPTION OF THE INVENTION

Referring first to FIG. 1, shown therein is a principal which is utilized in the present invention. It has been found that noble gases can be implanted into, held by and substantially released by rapid heating from, certain materials, such as silicon, to form what is termed an "atom bank". Certain other elements, such as copper in silicon, perform in a similar manner. Thus, the term "atom bank" as used herein is meant to describe a substrate/atom combination where the atoms of interest are readily incorporated into the substrate, are held by the substrate and are substantially released from the substrate upon rapid heating. The term "target" is equivalent to "atom bank".

Figures 1A, 1B:
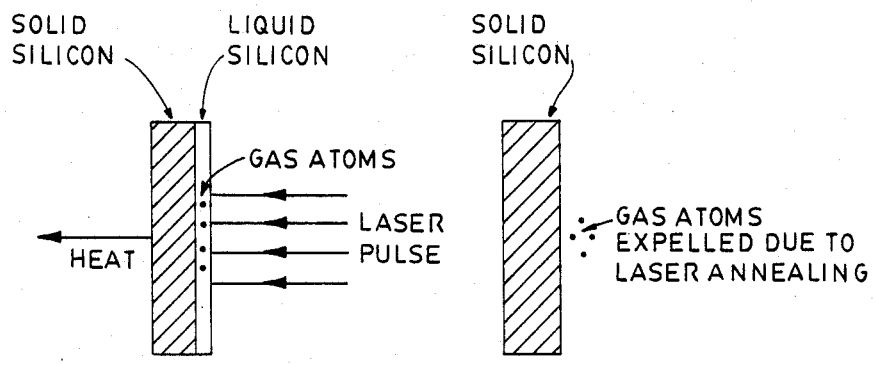
FIG. 1 is an illustration of the mechanism of the removal of noble gas atoms (or other atoms) from an atom bank, the bank being, for example, a purified silicon target into which the atoms have been implanted.

Noble gas atoms can be implanted, for example, by directing gas ions against a silicon target whereupon the ions are converted to atoms within the structure of the target. Following this implantation, it has been found that substantially all of the gas atoms can be released from the atom bank by quickly heating the target as with an annealing laser pulse. Other rapid heating means will also achieve this release. This is illustrated in Figure 1A. The laser pulse causes a liquid silicon layer to exist on the surface of the solid silicon target, with the excess heat being removed from the rear of the target. During this liquid silicon formation, the gas atoms contained in the region of the target that is melted are released so that, as shown in FIG. 2B, the gas atoms are not bound in the target when solidification occurs following the laser pulse. A very thin layer of the silicon surface is melted using, for example, a laser pulse of a sufficient energy delivered in a few (e.g., ten) nanoseconds. Typically an energy of about 0.2 Joules provides effective annealing.

Figure 2:
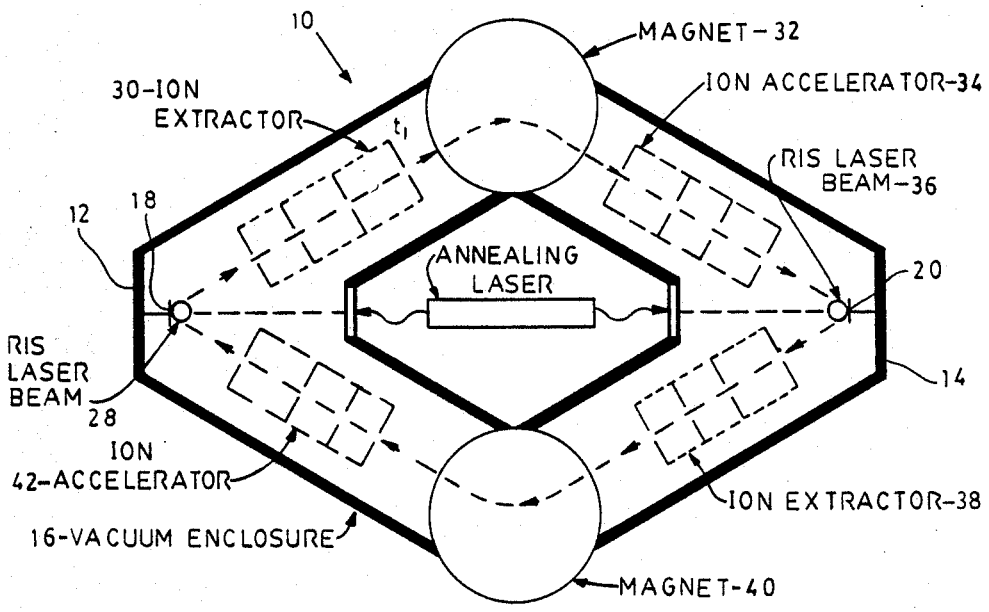
FIG. 2 is a schematic illustration of an apparatus for carrying out the method of the present invention.

The application of the rapid release of noble gas atoms from a substance such as silicon is utilized in the apparatus shown in FIG. 2 at 10 therein. Mounted within opposite ends 12, 14 of a continuously pumped vacuum enclosure 16 are a pair of targets or "atom banks" 18, 20. The vacuum is typical of the order of $10^{-9}$ Torr. The targets are typically purified silicon elements into which gas atoms are or can be implanted. An annealing laser 22 is provided external to the vacuum enclosure 16, such that laser pulses can penetrate windows 24, 26 such that the laser pulse can impinge upon the targets 18, 20. This annealing laser can be operated at 10 Hz, for example.

Adjacent target 18, and orientated substantially parallel with the surface thereof, is a first RIS (resonance ionization spectroscopy) beam 28. Typically, this beam can be created by an appropriate laser source external to the vacuum enclosure 16, operating at a frequency of about 0.1 to 10 Hz, and passed into the enclosure through the appropriate windows (not shown). (Other sources of photons for RIS are also applicable.) The ionization laser pulse is timed such that a majority of the ejected atoms from the target 18 are in the path of this beam for maximum ionization efficiency. The flux of the laser beam is selected to get substantially complete ionization; the value will depend upon factors such as the element, the volume and band width.

The ions produced by the laser beam 28 are extracted with an ion extractor 30, typically operated at about 0.5 to 3 kV, and caused to pass through a mass separator 32, in this instance a magnet. The magnet 32 accomplishes mass separation between the ions of interest and ions of other masses, with the ions of the selected species then passing through an ion accelerator 34 to be caused to impinge upon the second target 20 such that the ions become implanted therein. The acceleration potential is typically about 10 kV.

Provision is made to pass a second RIS (e.g., laser) beam 36 proximate the second target 20 so that, in a proper timed sequence, atoms released from the second target 20 by the annealing laser 22 are appropriately ionized. These ions are then subjected to a similar action by being extracted with ion extractor 38 and mass separation being provided through a magnet 40. The ions of interest are accelerated in ion accelerator 42 whereupon they impinge upon and are implanted into the first target 18. Operating conditions for these steps are substantially the same as set for the above. The isotopic enrichment factor may be as high as, for example, $10^4$ for each step in this apparatus.

Although not shown in this schematic figure, detectors are provided at each of the targets 18, 20 to measure the number of ions implanted in the targets, as by counting the number of electrons that are released. Typically this counting is achieved using an electron multiplier of the type known to those skilled in the art. The enrichment cycles are continued until the undersired isotopes have been substantially eliminated, and the desired isotopes are counted an additional number of times.

The ion extractors 30, 38, and the ion accelerators 34, 42, and the targets 18, 20 shown in FIG. 2 are provided with appropriate potentials from appropriate voltage sources (not shown) as will be understood by persons skilled in the art. Furthermore, appropriate timing circuits are provided for the operation of this apparatus in order that the ionization laser beams are initiated in a proper timed sequence with the annealing laser 22, and the subsequent application of the potentials to the ion extractors and the ion accelerators. The exact timing is dependent upon the size of the apparatus which controls the distance of movement of the ions of the selected species.

As stated above, the mass separation achieved in the apparatus 10 of FIG. 2 is accomplished through the use of magnets 32, 40. The particular scheme as shown in this figure is necessitated by the fact that ions travelling in an opposite direction through a single magnet would not be bent to follow the same paths as shown. Accordingly, the two separate paths would be required if conventional magnets are utilized. However, if other types of mass separators which do not depend upon the direction of entry into the mass analyzer are utilized in place of the magnets 32, 40,the ions in each step can transverse the same route but in opposite directions in a properly timed sequence. This will be illustrated in connection with FIGS. 4 through 6. Information about other types of mass separators is described hereinafter.

The apparatus 10 of FIG. 2 can also be used for release of atoms from both of the targets 18, 20 simultaneously. Thus, target 18 can be, for example, a sample of unknown ratio of the desired isotopic species, and target 20 can contain a known or standard quantity of such atoms. By operating both of the targets simultaneously, the results obtained from the "standard" sample can be compared to the unknown and, therefore, this comparison eliminates the effects of "shot-to-shot" variations in the output of the RIS lasers.

Figure 3B:
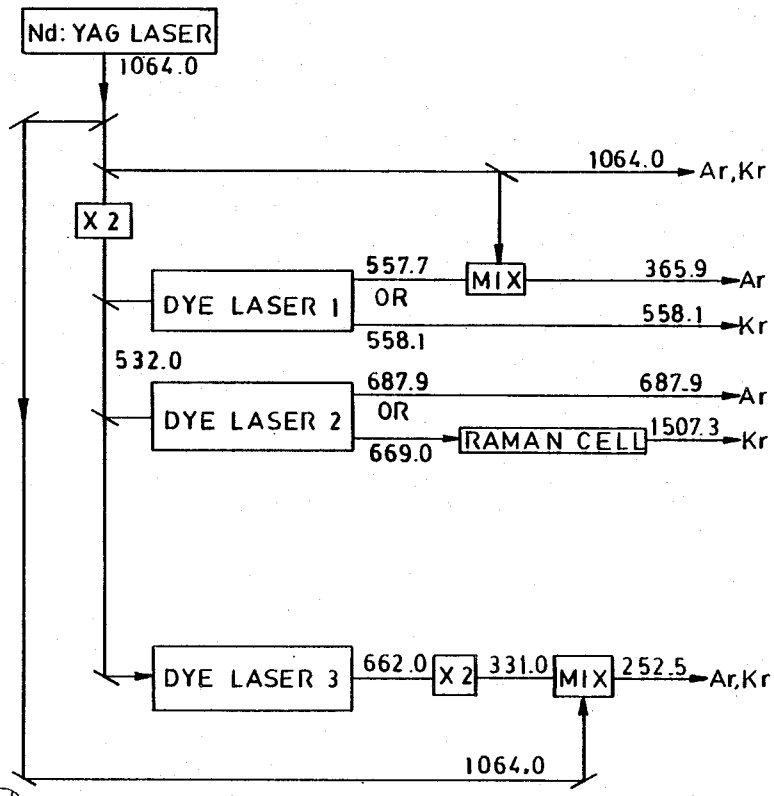
FIG. 3 is a drawing illustrating the resonance ionization spectroscopy schemes for the noble gases Kr and Ar showing the laser wavelengths for the ionization of these elements.
Figure 3A:
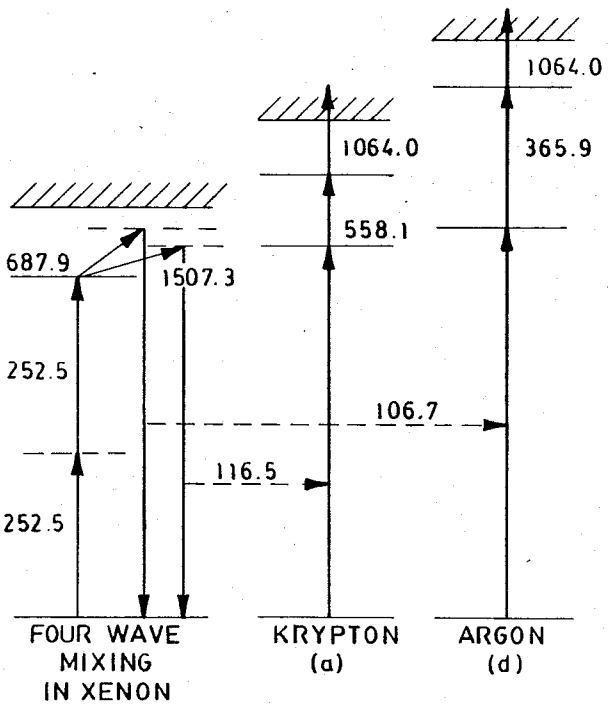

Referring now to FIG. 3, shown therein are typical ionization schemes for krypton and argon, both of these schemes involve the use of laser photons of three wave lengths having the values shown therein in FIG. 3A. In FIG. 3B are shown the mixing of the wave lengths from various types of lasers to achieve those wave lengths necessary for the ionization of the argon or krypton atoms. The wave lengths of 116.5 nm and 106.7 nm can be achieved with four-way mixing in xenon as shown in FIG. 3A. These are given as typical illustrations of the ionization of these atoms, and are not intended to be a limitation thereof.

As stated above with reference to FIG. 2, a magnetic mass spectrometer is utilized because magnetic devices provide high mass selection (abundance sensitivity) and high throughput efficiency of the ions. Other options for mass selection, however, are available. For example, as discussed in the above-referenced '354 patent, time-of-flight spectromers and quadrupole mass separators can be used in specific applications for mass separation. Generally, the quadrupole mass separator is not as attractive as the other options because of low throughput efficiency. In contrast, the time-of-flight mass separator is very applicable to the apparatus described herein because of its high throughput efficiency. Another form of mass selector known in the art is a Wien filter which utilizes both electric and magnetic fields. This will be discussed in greater detail with reference to FIG. 6 hereinafter.

Figure 4:
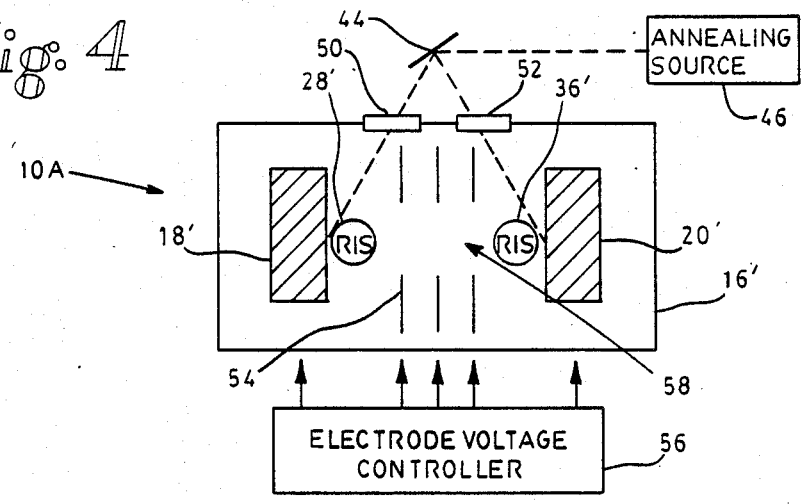
FIG. 4 is a drawing illustrating the use of a single annealing laser source to be used with two targets (atom banks).

Referring now to FIG. 4, shown therein is a schematic drawing of another apparatus 10A for accomplishing the present invention in those instances where the resonance ionization is accomplished with lasers that provide isotopic selectivity within the ionization step itself. According1y, the apparatus shown in FIG. 4 does not specifically include any mass separation device, such as the magnet shown in FIG. 2. In this embodiment, a single annealing laser source directs the output laser beam onto a mirror 44 which is caused to oscillate by any suitable means whereby the annealing laser beam passes first through window 50 and then window 52 so as to fall, respectfully, on target 18' and target 20'. Spaced between the targets 18' and 20' are a plurality of electrodes 54, with these electrodes being provided potential from an electrode voltage controller 56. This controller 56 would contain appropriate timing circuits for the application of the potentials to the electrodes 54. In this manner, a region 58 is achieved which is equivalent to both the ion extractor region 30 and the ion accelerator region 34, shown in FIG. 2. The two RIS laser beams 28' and 36' correspond to the RIS beams 28 and 36 of FIG. 2. In this embodiment, the atoms are first ejected from, for example, target 18', and thereafter are ionized by laser beam 28'. Appropriate voltages applied to the electrodes 54 cause these ions to be extracted and then accelerated to impinge upon and be implanted in target 20'. The atom release and ionization are then achieved at target 20' with the ions being extracted and then accelerated to impinge upon and be implanted in target 18' in a manner similar to that described with respect to FIG. 2.

Figure 5:
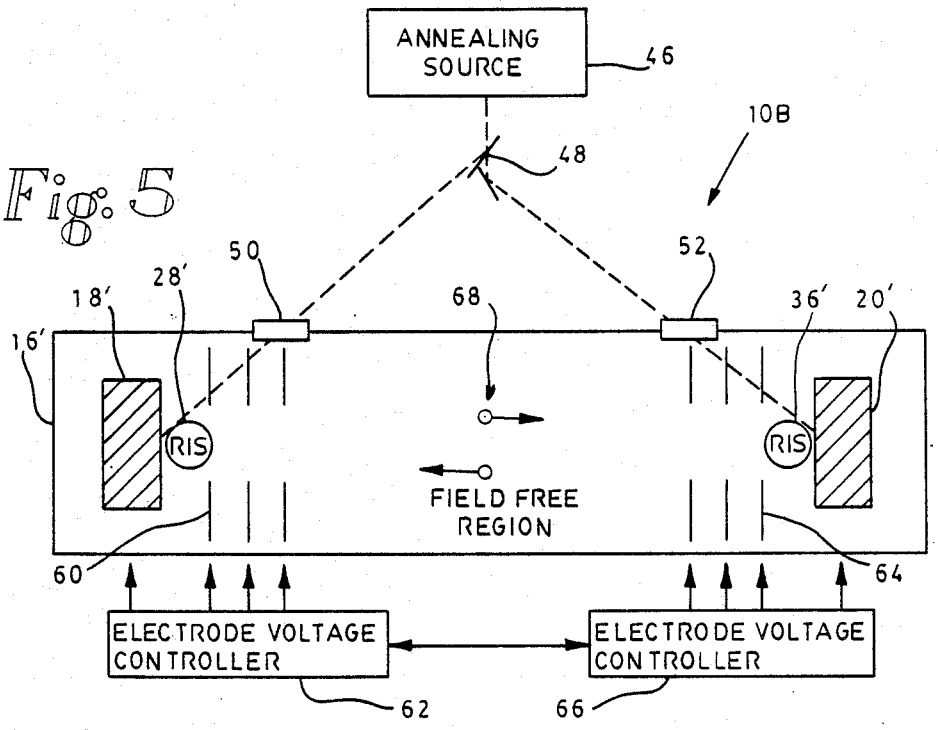
FIG. 5 is a drawing illustrating a device corresponding to that of FIG. 4 wherein a field-free region separates the two targets and the accelerating regions needed for implantation of the noble gases (or other atoms) therein to form the atom banks.

Another possible combination of components for accomplishing the present invention is illustrated at 10B in the diagram of FIG. 5. Several of the components are identical with those of FIG. 4, and thus carry the same identification numbers. The principal difference of the apparatus of FIG. 4 are that mirror 48 is of the beam splitting type permitting simultaneous annealing of targets 18' and 20' and that target 18'is provided with adjacent electrodes 60, with those electrodes being provided with appropriate potentials from electrode voltage controller 62. In a similar manner, target 20' has associated therewith a plurality of electrodes 64 with the potential for these electrodes being applied from an electrode voltage controller 66. Alternatively, the electrode voltage controllers 62 and 66 can be combined into a separate unit with appropriate timing controls to provide the necessary potentials on the electrodes 60 and 64. In this particular embodiment, ions are extracted simultaneously away from the ionization beams 28' and 36' by suitable potentials applied to electrodes 60 and 64. These ions then pass through a field free region 68 which is a time-of-flight type of mass separator. The ions then arrive in a particular timed sequence at electrodes 60 and 64 where the appropriate ions can be accelerated to impinge upon and implant in targets 18' and 20'. It should be noted that ionization beams 28' and 36' need not be isotopically selective in this embodiment because of the mass separation provided by the time-of-flight.

Figure 6:
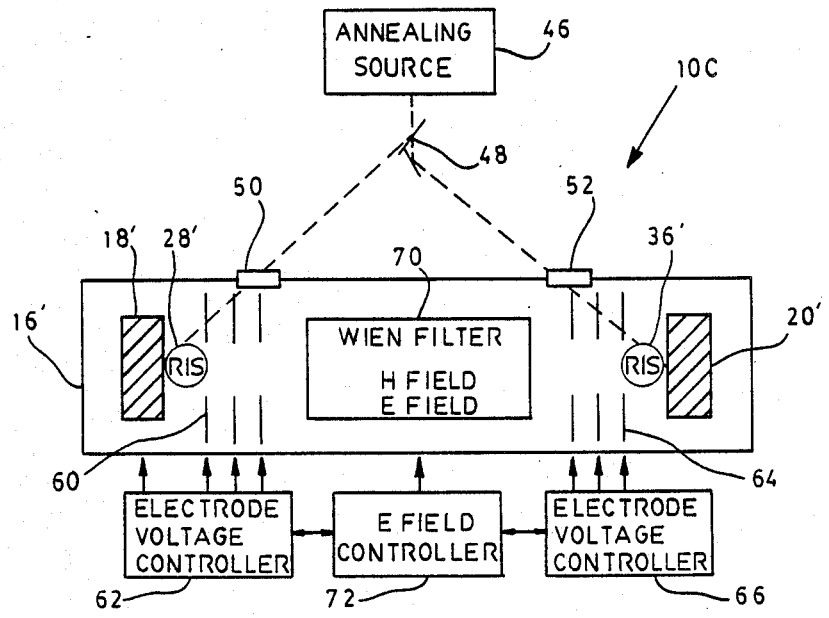
FIG. 6 is a drawing illustrating the use of a Wein Filter to accomplish the further mass separation in the devices of the present invention.

Still another embodiment of the present invention is illustrated at 10C in FIG. 6. This embodiment has several similarities to the embodiment illustrated in FIG. 5 with the addition of a Wein filter utilized for mass separation. A Wein filter, which is a device using a combination of a magnetic field and an electric field, provides for the transmission of the desired mass without deflection. The filter can be provided with a controller 72 which provides for the reversal of the electric field and thereby permits the reversal of direction of transmission of positive ions. The magnetic field cannot be easily reversed because of magnetic hysteresis, and it is for that reason that two separate magnets were utilized in the embodiment shown in FIG. 2. If it is desirable to process both of the targets simultaneously, the Wein filter 70 can be placed closer to one atom bank than to the other so that when ions meet on one side of the filter there is sufficient time to reverse the electric field. Alternately, the acceleration cycle provided by the electrode voltage controllers 62, 66 can be made to provide ions of two slightly different energies. This particular embodiment of FIG. 6 can be utilized without having isotopic selectivity achieved by the resonance ionization laser beams, or can be used with isotopic selectivity within the ionization to achieve further isotopic selectivity.

In order to avoid excessive losses after a few cycles within the apparatus shown in FIGS. 2 and 4 through 6, ionization efficiencies greater than about fifty percent are required. Glass slab lasers serving as pumps for VUV generation can provide the necessary efficiency at a sufficient rate. The isotopic enrichment provided in the above-described devices is sufficient to achieve the required enrichment to allow final counting of the desired isotope after only a few cycles. Heretofore, the best processing time involved approximately one hour for each counting cycle.

From the foregoing, it will be recognized by those versed in the art that a method and apparatus have been described which will provide for the counting of a few atoms of one isotope of a noble gas in the presence of a large quantity of adjacent isotopes. Furthermore, this analysis for the selected isotope is achieved in a very rapid manner. The method and apparatus are amenable to the simultaneous analysis of two samples, one of which may be a "standard" for comparison.

The teachings contained herein will enable one skilled in the art to select a suitable means for annealing the atom banks, for the resonance ionization, and the means for determining the number of ions implanted in a target. Also, such person skilled in the art will be able to select the operating conditions for a particular specie of interest.

Although specific embodiments of the present invention are described herein, these embodiments are not intended to limit the scope of the invention. Accordingly, the invention is to be defined by the scope of the appended claims and their equivalents.

We claim:

1. A method for counting atoms of a desired specie which may be small in number, such method conducted within an evacuated chamber, which comprises:
   - rapidly releasing atoms from a first atom bank containing such desired specie;
   - resonantly ionizing a portion of atoms of such desired specie removed from said first atom bank:
   - extracting said ions of such desired specie;
   - implanting said extracted ions into a second atom bank; and
   - measuring the number of ions implanted in said second atom bank as a measure of the number of atoms of such desired specie.

2. The method of claim 1, further comprising:
   - rapidly releasing atoms of said desired specie from said second atom bank;
   - resonantly ionizing a portion of said atoms removed from said second atom bank;
   - extracting ions of such desired specie derived from atoms released from said second atom bank;
   - implanting said extracted ions derived from atoms released from said second atom bank into said first atom bank; and
   - measuring the number of ions implanted in said first atom bank as a measure of the number of atoms of such desired specie.

3. The method of claim 1 wherein such selected specie is an isotope of a noble gas and said resonant ionizing step provides isotopic selectivity for such specie.

4. The method of claim 2 wherein such selected specie is an isotope of a noble gas, and said resonant ionizing steps provide isotopic selectivity.

5. The method of claim 1 further comprising passing said extracted ions through a mass separator to enhance said desired specie prior to said implanting step.

6. The method of claim 2 further comprising passing said extracted ions derived from atoms released from said first and second atom banks through a mass separator to enhance said desired specie prior to said implanting steps.

7. The method of claim 2 further comprising performing the steps repetitively until a selected enhancement of such desired specie is achieved.

8. The method of claim 2 wherein said release, ionization extraction and implantation steps are substantially complete for such desired specie whereby active vacuum pumping of such vacuum chamber eliminates interfering materials.

9. The method of claim 5 wherein said mass separator is a magnetic mass spectrometer.

10. The method of claim 6 wherein said mass separator is a first magnetic mass spectrometer, for said extracted ions derived from atoms released from said first atom bank and a second magnetic mass spectrometer for extracted ions derived from atoms released from said second atom bank.

11. The method of claim 5 wherein said mass separator is a time-of-flight mass spectrometer.

12. The method of claim 6 wherein said mass separator is a single time of flight mass separator for extracted ions derived from atoms released from said first and second atom banks.

13. The method of claim 5 wherein said mass separator is a Wein filter mass spectrometer utilizing both electric and magnetic fields.

14. The method of claim 6 wherein said mass separator is a single Wein filter mass spectrometer, utilizing both electric and magnetic fields, for extracted ions derived from atoms released from both said first and second atom banks, with the electric field reversable to accommodate ion directions through said filter.

15. The method of claim 1 wherein said atoms are released from said first ion bank by subjecting said first ion bank to at least one pulse of an annealing laser beam.

16. The method of claim 2 wherein said atoms are released from said first atom bank by subjecting said first atom bank to at least one pulse of an annealing laser beam, and wherein said atoms are released from said second atom bank by subjecting said second atom bank to at least one pulse of an annealing laser beam.

17. The method of claim 16 wherein said pulses of an annealing laser beam are derived from a single laser source.

18. A method for counting atoms of a desired isotopic specie of a noble gas wherein the number of atoms of such desired specie is very small in quantity compared to atoms of neighboring masses, such method conducted within an evacuated chamber, which comprises:
   - placing an atom bank containing such noble gas in such evacuated chamber, said atom bank comprising a first silicon target having atoms of such noble gas implanted within approximately 100 Angstroms from a surface of said silicon;
   - rapidly melting a layer of said first silicon target to a sufficient depth to release atoms of such noble gas using an annealing laser beam having a duration of about 10 nanoseconds;
   - ionizing a portion of said noble gas atoms leased from said first atom bank using laser-initiated resonance ionization;
   - extracting ions using electrodes having appropriate potentials applied thereto;
   - accelerating said extracted ions using electrodes having appropriate potentials applied thereto;
   - performing mass analysis on said ions between said ionizing step and said accelerating step to select such desired isotopic specie;
   - implanting said accelerated ions into a second silicon target to a depth of about 100 Angstroms to form a second atom bank;
   - measuring the number of electrons produced during said implantation in said second silicon target as a measure of the quantity of atoms of such desired specie contained in said first silicon target;
   - rapidly melting a layer of said second silicon target to a sufficient depth to release said implanted atoms of such desired isotopic specie using an annealing laser beam having a duration of about 10 nanoseconds;
   - ionizing a portion of said atoms released from said second silicon target using laser-initiated resonance ionization;

extracting ions derived from atoms released from said second silicon target using electrodes having appropriate potentials applied thereto;

accelerating said extracted ions derived from atoms released from said second silicon target using electrodes having appropriate potentials applied thereto;

performing mass analysis on said ions between said ionizing step and said accelerating step of said extracted ions derived from atoms released from said second silicon target to select such desired isotopic specie;

implanting said accelerated ions of such selected specie into said first silicon target;

measuring the number of electrons produced during said implantation into said first silicon target as a measure of the number of atoms of such noble gas in said second silicon target; and repeating said steps between said first and second silicon targets until said measuring of said electrons is substantially stablilized, said number of electrons then being a measure of the number of atoms of such desired isotopic specie in said silicon targets.

19. A method for counting atoms of a desired specie of a noble gas in a first sample and for comparing that number with the number of such desired specie in a second sample, where the atoms of said desired specie is very small in quantity compared to atoms of neighboring masses, such method conducted within a continuously evacuated chamber, comprising the steps of:

placing a first atom bank into such evacuated chamber at a first selected location, said first atom bank comprising a first silicon target having atoms of such noble gas of such first sample implanted therein;

placing a second atom bank into such evacuated chamber at a second selected location, said second atom bank comprising a second silicon target having atoms of such noble gas of such second sample implanted therein;

simultaneously melting a layer of said first and second silicon targets to a sufficient depth to release atoms of such noble gases using annealing laser beam pulses of substantially identical energy and duration;

simultaneously ionizing a portion of atoms released from each of said first and second atom banks using laser beams having substantially identical energies and wavelengths appropriate to ionize said released atoms through resonance ionization;

simultaneously extracting from said ions derived from said first and second atom banks, under substantially identical conditions, ions of such desired specie;

simultaneous accelerating extracted ions derived from said first atom bank toward said second silicon target and extracted ions derived from said second atom bank toward said first silicon target under substantially identical conditions;

performing mass analyses an ions between said ionizing step and said accelerating step toward said second silicon target, and of ions between said ionizing step and said accelerating step toward said first silicon target, said mass analyses being under substantially identical conditions:

implanting ions of said selected specie originating from atoms released from said first atom bank into said second silicon target, and ions of said selected specie originating from atoms released from said second atom bank into said first silicon target;

measuring the number of electrons produced during implantation into said second silicon target and the number of electrons produced during implanation into said first silicon target; and comparing said numbers of electrons as a measure of such comparing of such desired specie in each of such first and second samples.

20. An apparatus for counting atoms of a desired specie which may be small in number, which comprises:

an enclosure maintained at a selected vacuum value by continuous vacuum pumping;

a first atom bank positioned at a first location within said enclosure;

a second atom bank positioned at a second location within said enclosure;

first annealing means for rapidly annealing said first atom bank to release implanted atoms of such desired specie from said first atom bank;

first means for producing and passing a photon beam through said released atoms, said photon beam tuned to selectively ionize said removed atoms of such desired specie through resonance ionization spectroscopy;

first extraction means within said enclosure to extract ions of such desired specie from said ions produced by said photon beam;

first accelerating means within said enclosure to accelerate said extracted ions of such desired specie to an energy sufficient to implant said extracted ions into said second atom bank; and first measuring means for determining the number of ions implanted into said second atom bank.

21. The apparatus of claim 19 further comprising means for mass analyzing said ions interposed between said first extraction means and said first accelerating means.

22. The apparatus of claim 19 wherein said first means for producing said photon beam is a laser source tuned to selectively ionize such desired specie with isotopic selectivity.

23. The apparatus of claim 19 further comprising:

second annealing means for rapidly annealing said second atom bank to release implanted atoms of such desired specie from said second atom bank;

second means for producing and passing a separate photon beam through said atoms released from said second atom bank, said separate photon beam tuned to selectively ionize said atoms of such selected specie through resonance ionization spectroscopy;

second extraction means within said enclosure to extract ions of such selected specie from ions produced by said second separate photon beam;

second accelerating means within said enclosure to accelerate said ions extracted from ions produced by said second separate photon beam to an energy sufficient to implant said extracted ions into said first atom bank; and second measuring means for determining the number of ions implanted into said first atom bank.

24. The apparatus of claim 22 further comprising second means for mass analyzing ions interposed between said second extraction means and said second accelerating means.

25. The apparatus of claim 22 wherein said second means for producing said photon beam is tuned to selectively ionize such desired specie with isotopic selectivity.

26. The apparatus of claim 22 further comprising means for simultaneously operating said first annealing means simultaneously with said second annealing means; means for simultaneously energizing said first extraction means said second extraction means; and means for simultaneously operating said first acceleration means and said second accelerating means; whereby ions of such selected specie are implanted into said first and second atom banks substantially simultaneously.

27. The apparatus of claim 22 further comprising control means for converting in a proper time sequence said first extraction means into said second accelerating means, and said first accelerating means into said second extraction means.

* * * * *